United States Patent [19]

Peel et al.

[11] Patent Number: 4,636,357

[45] Date of Patent: Jan. 13, 1987

[54] ALUMINUM ALLOYS

[75] Inventors: Christopher J. Peel, Fleet; Brian Evans, Church Crookham; Samuel J. Harris, Nottingham; Brian Noble, Derby; Keith Dinsdale, Nottingham, all of England

[73] Assignee: The Secretary of State for Defence in Her Britannic Majesty's Government of the United Kingdom of Great Britain and Northern Ireland, London, England

[21] Appl. No.: 617,997

[22] PCT Filed: Sep. 19, 1983

[86] PCT No.: PCT/GB83/00229

§ 371 Date: Jun. 4, 1984

§ 102(e) Date: Jun. 4, 1984

[87] PCT Pub. No.: WO84/01391

PCT Pub. Date: Apr. 12, 1984

[30] Foreign Application Priority Data

Oct. 5, 1982 [GB] United Kingdom ..... 8228429

[51] Int. Cl.[4] ..... C22C 21/10

[52] U.S. Cl. ..... 420/532; 148/439; 148/440; 420/541

[58] Field of Search ..... 420/532, 541; 148/415, 148/417, 439, 440

[56] References Cited

U.S. PATENT DOCUMENTS 2,381,219 8/1945 LeBaron ..... 420/529

FOREIGN PATENT DOCUMENTS 2127909 12/1972 Fed. Rep. of Germany .
787665 12/1957 United Kingdom .

OTHER PUBLICATIONS

Jones et al., Journal of the Institute of Metals, vol. 88, 1959–1960, pp. 435–443.

Starke, Jr. et al., Journal of the Metals, Aug. 1981, pp. 24–32.

*Primary Examiner*—R. Dean

*Attorney, Agent, or Firm*—Cushman, Darby & Cushman

[57] ABSTRACT

Aluminum alloys having compositions within the ranges (in Wt %) 0.2 to 3 lithium −0 to 4 magnesium −0.4 to 5 zinc −0 to 2 copper −0 to 0.2 zirconium −0 to 0.5 manganese −0 to 0.5 nickel −0 to 0.4 chromium-balance aluminum. The alloys are precipitation hardenable and exhibit a range of properties, according to heat treatment, which made them suitable for engineering applications where light weight and high strength are necessary.

11 Claims, No Drawings

ALUMINUM ALLOYS

This invention relates to aluminium alloys having improved properties and reduced densities and being particularly suitable for use in aerospace airframe applications.

It is known that the addition of lithium to aluminium alloys reduces their density and increases their elastic moduli producing significant improvements in specific stiffnesses. Furthermore the rapid increase in solid solubility of lithium in aluminium over the temperature range 0° to 500° C. results in an alloy system which is amenable to precipitation hardening to achieve strength levels comparable with some of the existing commercially produced aluminium alloys.

Up to the present time the demonstrable advantages of lithium containing alloys have been offset by difficulties inherent in the actual alloy compositions hitherto developed. Only two lithium containing alloys have achieved significant usage in the aerospace field. These are an American alloy, X2020 having a composition Al-4.5Cu-1.1Li-0.5Mn-0.2Cd (all figures relating to composition now and hereinafter are in wt%) and a Russian alloy, 01420, described in UKP No. 1,172,736 by Fridlyander et al and containing Al-4 to 7mg-1.5 to 2.6Li-0.2 to 1.0Mn-0.5 to 0.3Zr (either or both of Mn and Zr being present.

The reduction in density associated with the 1.1% lithium addition to X2020 was 3% and although the alloy developed very high strengths it also possessed very low levels of fracture toughness making its efficient use at high stresses inadvisable. Further ductility related problems were also discovered during forming operations.

The Russian alloy 01420 possesses specific moduli better than those of conventional alloys but its specific strength levels are only comparable with the commonly used 2000 series aluminium alloys so that weight savings can only be achieved in stiffness critical applications.

Both of the above alloys were developed during the 1950's and 1960's.

For some years after these alloys the focus of attention of workers in the field centred upon the aluminium-lithium-magnesium system. Similar problems were again encountered in achieving adequate fracture toughness at the strength levels required.

A more recent alloy published in the technical press has the composition Al-2Mg-1.5Cu-3Li-0.18Zr. Whilst this alloy possesses high strength and stiffness the fracture toughness is still too low for many aerospace applications. In attempts to overcome problems associated with high solute contents such as, for example, cracking of the ingot during casting or subsequent rolling, many workers in the field have turned their attention to powder metallurgy techniques. These techniques whilst solving some of the problems of a casting route have themselves many inherent disadvantages and thus the problems of one technique have been exchanged for the problems of another. Problems of a powder route include those of removal of residual porosity, contamination of powder particles by oxides, practical limitations on size of material which can be produced and the inevitably higher cost.

Further work has been carried out on the aluminium-lithium-magnesium-copper system. This work has shown that by reducing the amount of solute content and optimising the composition at a more dilute level an acceptable balance of properties including fracture toughness may be achieved. This work is described in copending UK patent application No. 8304923.

Continuing work has shown that other useful alloys may be produced based on the aluminium-lithium system but having different additional alloying elements.

According to the present invention an aluminium based alloy comprises the following composition expressed in weight percent:

| | |
|---|---|
| Lithium | 2.0 to 3.0 |
| Magnesium | 0 to 4.0 |
| Zinc | 0.4 to 5.0 |
| Copper | 0 to 2.0 |
| Zirconium | 0 to 0.2 |
| Manganese | 0 to 0.5 |
| Nickel | 0 to 0.5 |
| Chromium | 0 to 0.4 |
| Aluminium | balance |

Additions of zinc have been found to give improved properties without significant reduction of ductility. Zinc additions contribute to the improvement in mechanical properties mainly by precipitation hardening and to some extent by solid solution hardening. So that ductility and fracture toughness are maintained to an acceptable level additions of the other alloying elements will not all be made at their maximum levels. The elements lithium, magnesium and copper all contribute to the alloy properties due to both solid solution strengthening and precipitation hardening. As a consequence of this it follows that an alloy having additions of those elements at their maximum levels will have a high hardness and correspondingly low ductility and fracture toughness even in the fully solution treated form.

At any given lithium level those alloys having additions of zinc and copper towards the upper limits of the ranges given above will have smaller density reduction than more dilute alloys, fracture toughness and ductility will also be reduced. Within range defined above there is, therefore, a preferred composition range of the major alloying elements within which alloys may be produced having a density range of 2.53 to 2.59 g/ml and an acceptable balance of properties. The preferred composition range is wt % is 2.3 to 2.6 lithium, 1 to 2 magnesium, 0.5 to 1 copper, 2 to 3 zinc and balance aluminium.

The precipitation hardening phase formed between magnesium and zinc is $MgZn_2$ magnesium combining with zinc to form the precipitate in an approximate weight ratio of 1:5 but in order to allow for some magnesium to combine with impurities, principally silicon, the magnesium addition will normally be increased to approximately a weight ratio of 1:4 magnesium:zinc. However, if copper additions are also made to the alloy to increase strength further magnesium may preferably be added in order that the maximum potential precipitate may be formed. Therefore, in the presence of copper, magnesium additions will be in excess of the approximate 1:4 magnesium:zinc weight ratio. Magnesium may of course also be added in excess of these ratios to endow a degree of solid solution strengthening.

The elements zirconium, manganese, nickel and chromium are used to control recrystallisation and hence grain size during subsequent heat treatment following mechanical working. Preferably not all of these elements are added simultaneously. Zirconium additions have been found to have the most beneficial effect on properties. Strength and ductility improvements in zirconium containing alloys can be directly related to the reduced grain size produced by the use of zirconium. A preferred level of zirconium addition would be 0.15 wt%. It has been found that strength benefits may be achieved by having a combined addition of some of these elements. An addition of 0.07% Zr plus 0.2% Mn having been found to be beneficial in some instances.

It has been found with alloys according to the present invention that a wider range of precipitation heat treatment temperatures is available. Good properties being achievable with relatively low temperatures of about 150° C. within practical times.

Examples of alloys according to the present invention are given below in Table I.

TABLE I

| Ex. No. | Li | Zn | Mg | Cu | Zr | Density g/ml |
|---|---|---|---|---|---|---|
| 1 | 2.2 | 5.0 | 1.13 | — | 0.19 | 2.56 |
| 2 | 2.3 | 4.85 | 1.04 | 0.96 | 0.17 | 2.60 |
| 3 | 2.2 | 4.22 | 4.03 | — | 0.20 | 2.53 |
| 4 | 2.4 | 3.97 | 3.82 | 0.96 | 0.18 | 2.55 |
| 5 | 2.65 | 2.21 | 0.58 | — | 0.12 | 2.54 |
| 6 | 3.0 | 2.03 | 1.03 | 1.0 | 0.12 | 2.51 |

Table II below gives tensile properties, densities and Youngs modulus together with solution and precipitation heat treatments for the alloys of Table I.

TABLE II

| Ex No | L/T | Solution Treatment | Stretch | Ageing | 0.2% P.S. MPa | TS MPa | % El | E GPa |
|---|---|---|---|---|---|---|---|---|
| 1 | L | 540° C., CWQ | — | 16 hr 90° C. + 24 hr 150° C. | 343 | 466 | 3.4 | |
| " | " | " | — | 16 hr 90° C. + 24 hr 150° C. | 348 | 463 | 4.3 | 78.2 |
| " | " | " | 3% | 16 hr 90° C. + 24 hr 150° C. | 410 | 529 | 4.3 | |
| 2 | " | " | — | 16 hr 90° C. + 24 hr 150° C. | 395 | 507 | 4.0 | |
| " | " | " | — | 24 hr 150° C. | 410 | 521 | 4.6 | 80.2 |
| " | " | " | 3% | 24 hr 150° C. | 482 | 552 | 2.2 | |
| 3 | " | " | — | 16 hr 90° C. + 24 hr 150° C. | 388 | 520 | 4.4 | |
| " | " | " | — | 24 hr 150° C. | 390 | 510 | 3.6 | 78.6 |
| " | " | " | 3% | 24 hr 150° C. | 504 | 541 | 1.0 | |
| 4 | " | 530° C., CWQ | — | 16 hr 90° C. + 24 hr 150° C. | 440 | 494 | 2.1 | |
| " | " | " | — | 24 hr 150° C. | 459 | 459 | 2.6 | 79.6 |
| " | " | " | 3% | 24 hr 150° C. | 498 | 546 | 1.0 | |
| 5 | L | 460° C./20 mins/CWQ | — | 16 hr 150° C. | 369 | 448 | 5.0 | |
| " | T | " | — | 16 hr 150° C. | 384 | 448 | 7.1 | |
| " | L | " | — | 16 hr 170° C. | 372 | 441 | 4.6 | |
| " | T | " | — | 16 hr 170° C. | 389 | 443 | 7.1 | |
| " | L | " | 2% | 16 hr 150° C. | 367 | 429 | 2.9 | |
| " | T | " | " | 16 hr 150° C. | 378 | 431 | 4.2 | |
| " | L | " | " | 16 hr 170° C. | 375 | 435 | 4.8 | |
| " | T | " | " | 16 hr 170° C. | 375 | 430 | 5.2 | |
| " | L | 500° C./20 mins/CWQ | " | 16 hr 150° C. | 368 | 401 | 4.6 | |
| " | T | " | " | 16 hr 150° C. | 363 | 466 | 7.7 | |
| " | L | " | " | 16 hr 170° C. | 378 | 480 | 6.2 | |
| " | T | " | " | 16 hr 170° C. | 380 | 440 | 2.7 | |
| " | L | " | " | 12 hr 170° C. | 380 | 474 | 7.0 | |
| " | T | " | " | 24 hr 170° C. | 397 | 480 | 7.4 | |
| 6 | L | 520° C./20 mins/CWQ | — | 16 hr 150° C. | 352 | 437 | 4.1 | |
| " | T | " | — | 16 hr 150° C. | 366 | 437 | 4.5 | |
| " | L | " | — | 16 hr 170° C. | 383 | 441 | 2.1 | |
| " | T | " | — | 16 hr 170° C. | 408 | 453 | 3.9 | |

CWQ = Cold water quench.

All of the Example alloys denoted in Table I were produced by conventional water cooled chill casting methods. Casting parameters were chosen to suit both the alloy and the equipment used. Fluxes based on lithium chloride were used to minimise lithium loss during the molten stage. Homogenisation treatments were employed on the cast ingots, temperatures of 490° C. being typical. Ingots were hot worked by rolling or extrusion down to sizes from which cold rolling could be utilised with subsequent heat treatment and production of test samples from the sheet so produced.

The examples given above have been limited to material produced in sheet form. However, alloys of the present invention are also suitable for the production of material in the form of plate extrusions, forgings and castings.

Although alloys of the present invention have been described in the content of aerospace applications where the requirements of strength, fracture toughness and weight are very stringent they may also be used in other applications where light weight is necessary such as, for example, in land and sea vehicles.

We claim:

1. An aluminum alloy consisting essentially of the composition expressed below in weight percent

| | |
|---|---|
| lithium | 2.0 to 3.0 |
| magnesium | 0.5 to 4.0 |
| zinc | 2.0 to 5.0 |
| copper | 0 to 2.0 |
| zirconium | 0 to 0.2 |
| manganese | 0 to 0.5 |
| nickel | 0 to 0.5 |
| chromium | 0 to 0.4 |
| aluminum | balance |

and wherein the alloy contains at least one of the group consisting of zirconium, manganese, nickel and chromium.

2. An aluminum alloy according to claim 1 consisting essentially of the composition expressed below in weight percent

| | |
|---|---|
| lithium | 2.3 to 2.6 |
| magnesium | 1.0 to 2.0 |
| zinc | 2.0 to 3.0 |
| copper | 0.5 to 1.0 |
| zirconium | 0 to 0.2 |
| manganese | 0 to 0.5 |
| nickel | 0 to 0.5 |
| chromium | 0 to 0.4 |
| aluminum | balance |

and wherein the alloy contains at least one of the group consisting of zirconium, manganese, nickel and chromium.

3. An aluminium alloy according to claim 1 or claim 2 said alloy having been produced by an ingot metallurgy route.

4. An aluminium alloy consisting essentially of the composition expressed below in weight percent:

| | |
|---|---|
| lithium | 2.2 |
| magnesium | 1.13 |
| zinc | 5.0 |
| zirconium | 0.19 |

5. An aluminium alloy consisting essentially of the composition expressed below in weight percent:

| | |
|---|---|
| lithium | 2.3 |
| magnesium | 1.04 |
| zinc | 4.85 |
| copper | 0.96 |
| zirconium | 0.17 |

6. An aluminium alloy consisting essentially of the composition expressed below in weight percent:

| | |
|---|---|
| lithium | 2.2 |
| magnesium | 4.03 |
| zinc | 4.22 |
| zirconium | 0.20 |

7. An aluminium alloy consisting essentially of the composition expressed below in weight percent:

| | |
|---|---|
| lithium | 2.4 |
| magnesium | 3.82 |
| zinc | 3.97 |
| copper | 0.96 |
| zirconium | 00.18 |

8. An aluminium alloy consisting essentially of the composition expressed below in weight percent:

| | |
|---|---|
| lithium | 2.65 |
| magnesium | 0.58 |
| zinc | 2.21 |
| zirconium | 0.12 |

9. An aluminium alloy consisting essentially of the composition expressed below in weight percent:

| | |
|---|---|
| lithium | 3.0 |
| magnesium | 1.03 |
| zinc | 2.03 |
| copper | 1.0 |
| zirconium | 0.12 |

10. An aerospace airframe structure produced from an aluminium alloy according to claim 1 or claim 2.

11. A land or sea vehicle structure employing an aluminium alloy according to claim 1 or claim 2.

* * * * *